United States Patent [19]

Konrath

[11] 3,974,812

[45] Aug. 17, 1976

[54] SPEED REGULATOR FOR FUEL INJECTION PUMPS

[75] Inventor: Karl Konrath, Ludwigsburg, Germany

[73] Assignee: Robert Bosch G.m.b.H., Stuttgart, Germany

[22] Filed: Jan. 3, 1975

[21] Appl. No.: 538,469

[30] Foreign Application Priority Data

Jan. 18, 1974 Germany ..... 2402374

[52] U.S. Cl. ..... 123/139 ST; 123/140 R; 123/179 G

[51] Int. Cl.[2] ..... F02M 39/00

[58] Field of Search ..... 123/140 R, 140 J, 139 ST, 123/139 AZ, 179 L, 179 G

[56] References Cited

UNITED STATES PATENTS

| | | | |
|---|---|---|---|
| 3,638,631 | 2/1972 | Eheim | 123/139 ST |
| 3,759,236 | 9/1973 | Staudt et al. | 123/140 J |
| 3,884,206 | 5/1975 | Ritter | 123/140 R |

FOREIGN PATENTS OR APPLICATIONS

| | | | |
|---|---|---|---|
| 1,093,141 | 11/1960 | Germany | 123/139 ST |
| 1,954,834 | 5/1971 | Germany | 123/140 R |

*Primary Examiner*—Charles J. Myhre
*Assistant Examiner*—Paul Devinsky
*Attorney, Agent, or Firm*—Edwin E. Greigg

[57] ABSTRACT

A speed regulating device for fuel injection pumps of internal combustion engines includes an intermediate lever pivotable about an axis defined by a shaft which is coupled to a fuel quantity adjustment member of the injection pump. The shaft is acted on by a speed signalling device with speed dependent force against the arbitrarily variable force of a main control spring and the force of a starting spring. A speed signalling device acts on a one-armed adjustment lever, which is pivotably attached to the intermediate lever. The adjustment lever is acted on by the starting spring, and includes an adjustment capsule at its end. This adjustment capsule cooperates with a one-armed drag lever, pivotable, about the same axis defined by the shaft about which the intermediate lever pivots, as far as an adjustable stop. The drag lever is acted on by the main control spring. The adjustment lever includes a stop projecting in the direction of the drag lever between the point of contact of the speed signalling device and the attachment point on the intermediate lever.

10 Claims, 1 Drawing Figure

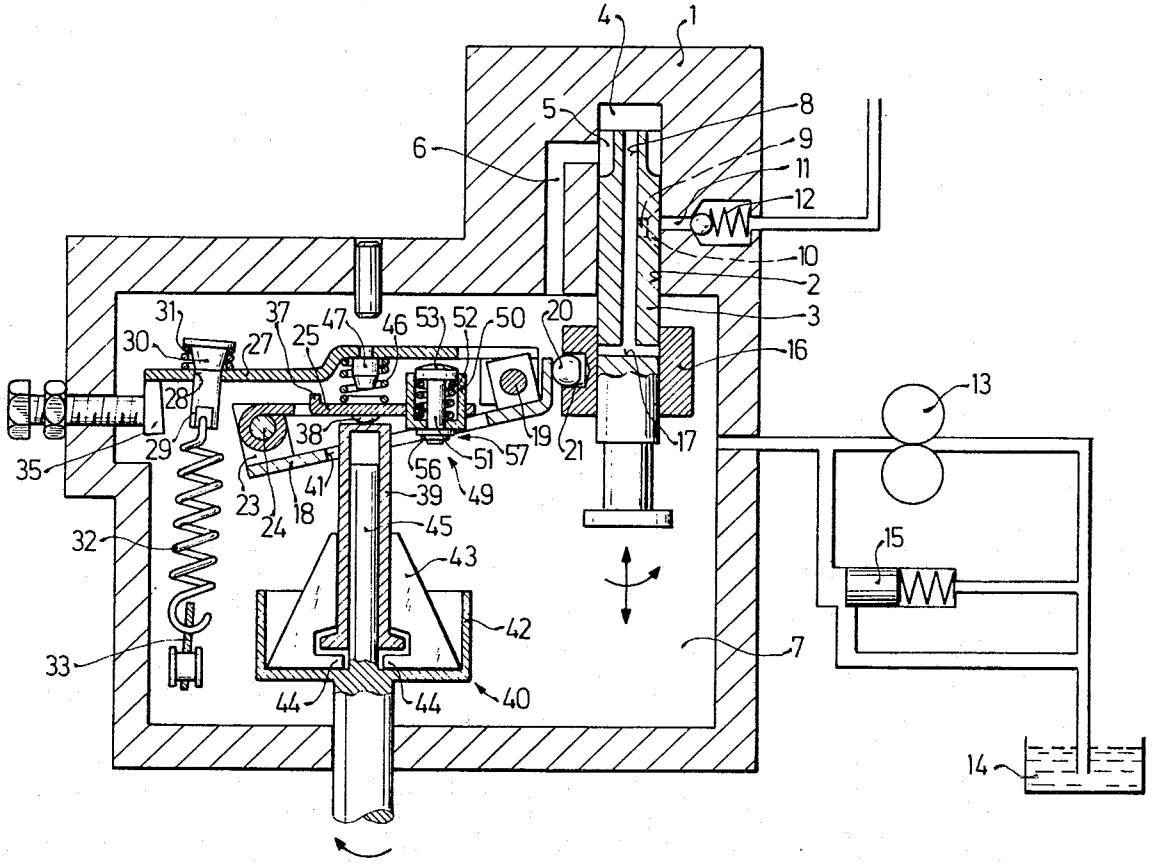
1
2
3
4
5
6
7
8
9
10
11
12
13
14
15
16
17
18
19
20
21
23
24
25
27
28
29
30
31
32
33
35
37
38
39
40
41
42
43
44
45
46
47
49
50
51
52
53
56
57

SPEED REGULATOR FOR FUEL INJECTION PUMPS

BACKGROUND OF THE INVENTION

This invention relates to a speed regulator for fuel injection pumps of internal combustion engines. The present invention is concerned, more particularly, with such a speed regulator which includes an intermediate lever pivotable about an axis defined by a shaft. Both the shaft and the intermediate lever are coupled with a flow quantity adjustment member of the injection pump and are acted on by a speed signalling device, with a speed dependent force, against the arbitrarily variable force of a main control spring and the force of starting spring.

An injection pump of the above-mentioned type is already known which includes a centrifugal force governor which acts against a main control spring of variable biasing, thereby adjusting the position of a regulating shaft. The displacement of the sleeve of the centrifugal force governor is thereby transmitted by a centrally located intermediate lever directly onto the regulating shaft and by a second lever which is rigidly connected to the intermediate lever onto a leaf spring which is held on an angled lever acted on by the main control spring and which is deformable on this angled lever as far as the position of an adjustable stop. The leaf spring thus cooperates with the main control spring against the positioning movement of the centrifugal force governor. As the positioning forces increase, the leaf spring is first deformed as far as its stop and thereafter the main control spring is deformed. Thus, the leaf spring which, during normal operation, constantly rests against its stop, enables a starting excess to be obtained which cuts off automatically after starting.

A fuel injection pump is also known which includes a centrifugal force governor which acts, with speed dependent force, on an intermediate lever coupled to the flow quantity adjustment member of the injection pump against the force of a main control spring and starting spring. In this case the main control spring is in the form of a tension spring and is secured to a drag lever which is pivotable about the same axis as the intermediate lever. The starting spring is also in the form of a tension spring and is secured to the outer end of the intermediate lever. Both springs have an adjustable lever as their second adjustment point and they can be adjusted in common via this adjustable lever. As the speed increases, the intermediate lever is moved by the centrifugal force governor against the force of the starting spring and then comes to rest against the drag lever which it lifts from a full load stop as the speed increases against the force of a main control spring, as a control measure.

The two above-mentioned types of speed regulators for injection pumps have the distinct disadvantage of not enabling the full load injection quantity to be adjusted according to the speed.

SUMMARY OF THE INVENTION

The principal object of the present invention is to provide a speed regulator of the type described initially which retains minimum dimensions, particularly in the operating direction of the speed signalling device, with which a starting excess is obtained which is automatically reduced to the normal injection quantity as the speed increases and which is combined with an adjustment device which, as the speed continues to increase after the starting quantity has been reduced, produces an increase in the quantity of fuel injected in the form of a negative adjustment.

The foregoing object, as well as others which are to become apparent from the text below, is achieved in that the speed signalling device acts on a one-armed adjustment lever which is pivotably attached to the intermediate lever and acted on by the starting spring. The adjustment lever includes at its end an adjustment capsule which cooperates with a one-armed drag lever pivotable about the axis of the intermediate lever as far as an adjustable stop, the main control spring engaging on this drag lever. The adjustment lever also includes a stop projecting the direction of the drag lever between the engagement point of the speed signalling member and the attachment point on the intermediate lever. Another feature according to the invention consists in that the starting spring is in the form of a pressure spring and is disposed in series with the main control spring between the adjustment lever and the drag lever. When a double lever arrangement is provided for producing a starting excess the possibility of the intermediate lever being displaced independently of the drag lever acted on by the main control spring is advantageously exploited. By coordinating the attachment of the adjustment lever, its stop, the adjustment capsule and the engagement point of the speed signalling member, the movement of the intermediate lever in the direction of the drag lever caused by the speed signalling member is reversed by the compression of the adjustment capsule, from the time when the stop of the adjustment lever rests against the drag lever and thus the initial adjustment in terms of reducing the injection quantity is reversed after cutting off the starting excess. The length of the travel stroke of the adjustment capsule determines the extent of the possible adjustment With this arrangement, even if an adjustment lever is not provided, the necessary space for housing a starting spring between the intermediate lever and the drag lever is used and thus there is no need to increase the working capacity of the centrifugal force governor in respect thereof.

Another feature of the invention consists in that the intermediate lever, the drag lever and the adjustment lever are pivotable in the same plane and in that the adjustment lever is disposed between the drag lever and the intermediate lever and the intermediate lever has, in its central region, a recess through which passes an adjustment sleeve of the speed signalling device and the adjustment capsule. As a result of this arrangement, the space requirement in the working direction of the speed signalling device remains minimal and furthermore, the three levers can be disposed very close to each other as a result of the fact that the adjustment lever can partially pass through the recess in the intermediate lever. Thus, a compact arrangement having a high operating capacity is obtained.

BRIEF DESCRIPTION OF THE DRAWING

The sole figure of drawing is a cross-sectional, front elevational view of a speed regulator according to the present invention in combination with a fuel injection pump and fuel supply, the latter being shown schematically.

DETAILED DESCRIPTION OF THE PREFERRED EMBODIMENT

As shown in the drawing, an illustrative embodiment of a speed regulator according to the present invention includes a housing 1 of a fuel injection pump having a pump piston 3 which is displaceable in a simultaneous reciprocating and rotating movement by conventional instrumentalities (not shown) against the force of a conventional restoring spring (not shown). The working chamber 4 of the pump is supplied with fuel from a suction chamber 7 via a longitudinal groove 5 disposed in the surface of the piston 3 and via a channel 6 disposed in the housing 1 for as long as the piston 3 makes its intake stroke and takes its lower dead center position. As soon as the channel 6 has been closed after commencing the compression stroke and after a corresponding rotation of the piston, the fuel in the pump working chamber 4 is conveyed along a longitudinal channel 8 provided in the piston 3. From the longitudinal channel 8 the fuel is supplied via a branching radial bore 9 and a longitudinal distribution groove 10 disposed in the surface of the piston to one of the pressure lines 11. The pressure lines 11 are distributed at the perimeter of the cylinder bore 2 in correspondence with the number of cylinders (not shown) to be supplied. Each of the pressure lines 11 runs via a respective check valve 12 opening in the flow direction to the injection valves (not represented) of the individual cylinders of the internal combustion engine supplied by this injection pump.

The suction chamber 7 is supplied with fuel via a pump 13 from a fuel storage container 14. The pressure in the section chamber 7 is controlled, in a manner known per se, by a pressure control valve 15 disposed in parallel to the fuel pump 13.

Cylindrical slide 16 surrounds and is displaceable on the piston 3. This slide 16 regulates a radial bore 17 which communicates with the longitudinal channel 8 during the compression stroke of the piston 3 and thus provides direct communication between the working chamber 4 and the pump suction chamber 7 and thus, from this regulation point on, the remaining fuel delivered by the piston 3 is not supplied to the pressure lines 11, rather, the fuel flows into the suction chamber 7. Thus, depending on the position of the slide 16, connection is made sooner or later to the pump suction chamber 7 and the fuel injection is interrupted. The farther the slide 16 is pushed in the direction of the upper dead center point of the piston 3, the greater the quantity of fuel which is supplied by the piston 3 to the pressure lines 11.

The slide 16 is displaced by an intermediate lever 18 which is pivotable about an axis defined by a shaft 19. The shaft 19 is disposed in the pump housing 1 and can be rotated, by way of an eccentric element, to adjust the pump. A head 20 which engages in a recess 21 in the slide 16 is attached to a lever arm of the intermediate lever 18 to move the slide 16. A bearing 23 with an axis defining shaft 24 is provided at the outer end of the other lever arm of the intermediate lever 18. An adjustment lever 25 which is in the same plane as the intermediate lever 18 is pivotable about the axis defined by the shaft 24. The adjustment lever 25 extends in the direction of the axis defined by the shaft 19 and thus shares a hinged overlapping relationship with the intermediate lever 18. Viewed from the pump piston 3 drive side, the adjustment lever 25 is disposed on the other side of the intermediate lever 25.

A one-armed drag lever 27 is also pivotable about the axis defined by the shaft 19 independently of the intermediate lever 18. The main position of the drag lever 27 is in overlapping relationship with the intermediate lever 18 such that the adjustment lever 25 is disposed between the intermediate lever 18 and the drag lever 27. The drag lever 27 includes a shoulder and near its free end is a bore 28 through which a bolt 29 is guided. Viewed from the pump piston 3 drive side, this bolt 29 includes a head 30 on the other side of the drag lever 27. An idling spring 31 is disposed between the head 30 and the drag lever 27. A main control spring 32 in the form of a tension spring is connected to the other end of the bolt 29. The main control spriing 32 is secured to an arbitrarily adjustable lever 33 at its other end. The lever 33 is used to adjust the biasing of the main control spring 32 and also to adjust the load. As a result of the biasing of the main control spring 32 the drag lever 27 is pressed by its free end against an adjustable stop 35.

Adjacent to its axis defined by shaft 24, the adjustment lever 25 includes a stop 37 projecting in the direction of the drag lever 27. In the direction of the axis defined by the shaft 19, the adjustment lever 25 includes a semi-spherical lug 38 projecting in the direction of the intermediate lever 18 and on which the adjustment sleeve 39 of a centrifugal governor 40 engages. The intermediate lever 18 includes a recess 41 in its central region through which the sleeve 39 of the centrifugal force governor 40 can pass. The centrifugal force governor 40 is driven by conventional gearing (not shown) according to the speed of the pump piston 3 and is provided with a carrier 42 having compartments in which centrifugal weights 43 are disposed. The centrifugal weights engage with nose-shaped parts 44 on the lower edge of the adjustment sleeve 39 which is displaced in the longitudinal axial direction on a shaft 45 of the centrifugal governor 40. When the sleeve 39 rests aagainst the semi-spherical element 38, it is possible to transmit the adjustment movement of the centrifugal governor 40, with the least amount of friction and momentum.

A starting spring in the form of a coiled compression spring 46, is disposed on the other side of the adjustment lever 25 opposite to the engagement point of the centrifugal force governor 40 between the adjustment lever 25 and the drag lever 27. The compression spring 46 tends to press the adjustment lever 25 onto the sleeve 39 of the centrifugal force governor 40 and is supported on the drag lever 27 which is held against the stop 35 by the main control spring 32.

Compression spring 46 which acts as a starting spring and accordingly must be yielding is guided by a pin 47 rigidly connected to the drag lever 27. At the end of the adjustment lever 25, an adjustment capsule 49 is disposed adjacent to the contact point of the compression spring 46 in the direction of the axis defined by the shaft 19. This adjustment capsule 49 includes, in a manner known per se, a supporting carrier member 50 which is vertically and rigidly set in the adjustment lever 25, and of a bolt 51 which is displaceable in this carrier member 50 against a compression spring 52. The capsule 49 may also be adjustably connected to the adjustment lever 25, for example, by way of a screw thread. The bolt 51, which is displaceable in the direction of the drag lever 27, includes at its end adjacent to the drag lever 27 a head 53 which, in the normal position, projects beyond the edge of the capsule 49 and is guided in the capsule 49. The other end of the bolt 51 penetrates the bottom of the capsule 49 in a bore and, on the other side thereof, has a stop 57 consisting of a retaining ring and one or more disks 56. The compression spring 52, which is supported internally on the bottom of the capsule 50 and on the head 53 of the bolt 51, tends to hold the bolt 51 against its stop 57. The adjustment capsule 49 is located in the region of the recess 41 disposed opposite the intermediate lever 18, and, for this reason, it can pass through this recess 41 together with the adjustment lever 25 under the action of the compression spring 46. As a result of this arrangement, the three levers 18, 25 and 27 are closely disposed one above the other and thus the overall arrangement is extremely compact in spite of its adjustment possibilities and it only requires a small amount of space. By selecting the compression spring 52, the stroke of the bolt 51 and the strength of the disk or disks 56 in front of the stop 57, the adjustment features can be adjusted according to the actual requirements.

The above-described arrangement operates as described in some detail below.

In the starting position, which is indicated, the drag lever 27 abuts against its full load adjustable stop 35 under the action of the main control spring 32. The adjustment lever 25 is simultaneously pressed onto the front side of the sleeve 39 of the centrifugal force governor 40 under the action of the compression spring 46, which is a starting spring. As a result, the intermediate lever 18 is removed from the drag lever 27 which causes a displacement of the slide 16 as a result of this pivoting movement into the upper starting position. The centrifugal weights 43 of the centrifugal force governor 40 are still in the starting position at this point. When the internal combustion engine starts up the injection pump is simultaneously driven which causes the centrifugal force governor 40 to rotate with increasing speed. As a result of the centrifugal forces which are produced, the centrifugal weights 43 are deflected outwardly and raise the sleeve 39 of the centrifugal force governor 40 with the nose-shaped parts 44 of the weights 43. This movement causes the simultaneous compression of the compression spring 46 and a displacement of the adjustment lever 25 in the direction of the drag lever 27. After the adjustment lever 25 with its stop 37, and with the head 53 of the adjustment capsule 49 has reached the drag lever 27, the cylindrical slide 16 is pushed downwardly by the intermediate lever 18 which is pivoted by the adjustment lever 25. At this point, the starting excess is cut off. As the speed of the engine increases, the drag lever 27 is not deflected against the force of the main control spring 32, but the compression spring 52 is compressed in the adjustment capsule 49. As a result, the adjustment lever 25 is pivoted about its stop 37 which is in contact with the drag lever 27 until the head 53 of the adjustment capsule 49 is completely inserted in the adjustment capsule 49 and the adjustment capsule 49 is firmly lodged on the drag lever 27. As a result of this pivoting movement, the intermediate lever 18 is moved in the opposite direction to that of the original operation for cutting off the starting excess and the cylindrical slide 16 is again moved to a certain extent in an upward direction and increases the quantity of fuel being injected. The drag lever 27 is only moved from its stop 35 against the force of the main control spring 32 through the action of increasing speed forces when the speed increases or when the final speed is reached. The other levers 18 and 25 are also moved simultaneously with the pivoting movement of the drag lever 27 and thus the sliding cylindrical slide 16 is again pushed downwardly and reduces the quantity of fuel being injected. The idling spring 31 will then commence to operate in a manner known per se according to the load on the internal combustion engine.

A compression spring biased between the adjustment lever 25 and a fixed point in the housing 1 can obviously be used in place of the compressing spring 46 which is disposed between the drag lever 27 and the adjustment lever 25. The attachment point of this spring on the housing 1 may also be made adjustable in a manner known per se.

The foregoing description and accompanying drawing illustration relate to an illustrative embodiment of a speed regulator and are set out by way of example, not by way of limitation. It is to be appreciated that numerous other embodiments and variants are possible within the spirit and scope of the invention, the scope being defined as the appended claims.

What is claimed is:

1. In a speed regulator for use with fuel injection pumps of internal combustion engines including an intermediate lever pivotable about a fixed axis defined by a shaft, said intermediate lever being coupled to a fuel quantity adjustment member of a fuel injection pump, and a speed response signalling device which generates a speed dependent force acting against an arbitrarily variable force of a main control spring and a force of a starting spring, the improvement comprising:

a. A one-armed adjustment lever pivotably attached to said intermediate lever at an attachment point spaced from said fixed axis, said speed signalling device being in contact with one surface of said adjustment lever and said starting spring being in contact with another surface of said adjustment lever so as to act in opposition to force applied by said device;

b. a one-armed drag lever having a free end and pivotably mounted at its other end for pivoting about said fixed axis defined by said shaft to which said intermediate lever is attached;

c. an adjustment capsule carried by said adjustment lever near its free end for engagement with said drag lever;

d. an adjustable stop positioned in the vicinity of said free end of said drag lever for limiting pivoting of said drag lever in one direction, said main control being attached to said drag lever near its said free end; an d e. a further stop, carried by said adjustment lever and projecting in the direction of said drag lever for engagement therewith, wherein:

i. said further stop is located between the area of contact of said speed signalling device and the attachment point of said adjustment lever to said intermediate lever; and ii. the area of contact of said speed signalling device is located between the area of engagement of said adjustment capsule with said drag lever and the attachment point of said adjustment lever to said intermediate lever.

2. A speed regulating device according to claim 1, wherein said intermediate lever, said drag lever and said adjustment lever are pivotable in a substantially common plane.

3. A speed regulating device as claimed in claim 1, wherein said starting spring is a compression spring disposed in series with said main control spring between said adjustment lever and said drag lever.

4. A speed regulating device according to claim 3, wherein said intermediate lever, said drag lever and said adjustment lever are pivotable in a substantially common plane.

5. A speed regulating device as claimed in claim 1, wherein said starting spring is a tension spring disposed parallel to said main control spring and acting on a point between said adjustment lever and an adjustable point of attachment to said housing.

6. A speed regulating device according to claim 5, wherein said intermediate lever, said drag lever and said adjustment lever are pivotable in a substantially common plane.

7. A speed regulating device as claimed in claim 1, wherein said speed signalling device includes an adjustment sleeve in contact with said adjustment lever, said adjustment lever being disposed between said drag lever and said intermediate lever and said intermediate lever having a recess in its central region for passage of said adjustment sleeve of said speed signalling device and said adjustment capsule.

8. A speed regulating device according to claim 7, wherein said intermediate lever, said drag lever and said adjustment lever are pivotable in a substantially common plane.

9. A speed regulating device as claimed in claim 7, wherein said starting spring is a compression spring disposed in series with said main control spring between said adjustment lever and said drag lever.

10. A speed regulating device as claimed in claim 7, wherein said starting spring is a tension spring disposed parallel to said main control spring and acting on a point between said adjustment lever and an adjustable point of attachment to said housing.

* * * * *